United States Patent [19]

Roule et al.

[11] Patent Number: 4,715,623

[45] Date of Patent: Dec. 29, 1987

[54] DOCUMENTS HAVING A REVEALABLE CONCEALED IDENTIFIER AND THE METHOD OF MAKING SUCH DOCUMENTS

[75] Inventors: Richard L. Roule, Westport, Conn.; Joshua C. Cantor, Westfield, N.J.

[73] Assignee: American Bank Note Company, New York, N.Y.

[21] Appl. No.: 655,713

[22] Filed: Sep. 28, 1984

[51] Int. Cl.[4] ..... G09F 3/00; G09F 19/16

[52] U.S. Cl. ..... 283/91; 283/74; 283/85; 283/113; 101/150; 428/167

[58] Field of Search ..... 283/91, 85, 94, 70, 283/74, 72, 113, 902, 57; 101/DIG. 22, 150, 426; 428/916, 167

[56] References Cited

U.S. PATENT DOCUMENTS

| | | | |
|---|---|---|---|
| 1,002,600 | 9/1911 | Morris et al. | 283/94 |
| 1,990,421 | 2/1935 | Taylor | 101/32 X |
| 3,279,826 | 5/1964 | Rudershausen et al. | 283/89 |
| 3,980,018 | 9/1976 | Ichikawa | 283/59 X |
| 4,033,059 | 7/1977 | Hutton et al. | 101/150 X |
| 4,124,947 | 11/1978 | Kuhl et al. | 101/150 X |
| 4,175,774 | 11/1979 | Tonges et al. | 283/93 |
| 4,352,706 | 10/1982 | Miller | 283/89 X |
| 4,420,515 | 12/1983 | Amon et al. | 283/113 |
| 4,455,039 | 6/1984 | Wietzen et al. | 283/904 X |

*Primary Examiner*—Howard N. Goldberg
*Assistant Examiner*—T. Ross
*Attorney, Agent, or Firm*—Cooper, Dunham, Griffin & Moran

[57] ABSTRACT

A method of impressing a secret pattern on a substrate by the use of an uninked intaglio printing plate having the foreground area with a pattern of ridges and grooves which are distinctively different from the ridges and grooves in a background area enclosing the foreground area. The secret pattern may be observed only a person who is informed as to what pattern he is looking for and how to look at that pattern. Particularly, his line of sight must make a certain angle with the plane of the impressed substrate. The line of sight must also be oriented properly with respect to the background and foreground areas.

8 Claims, 25 Drawing Figures

Fig. 1.
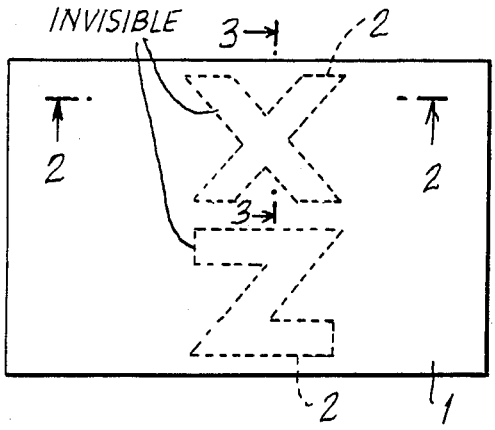
Fig. 3.
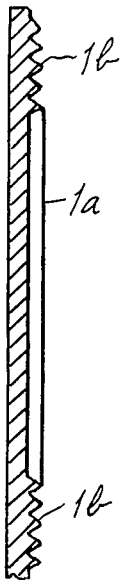
Fig. 2.
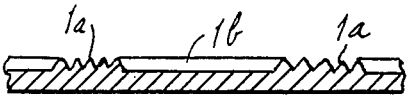
Fig. 4.
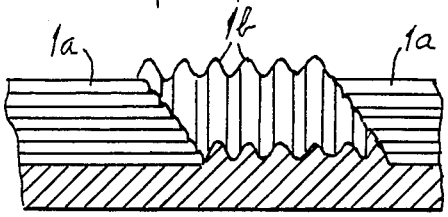
Fig. 6.
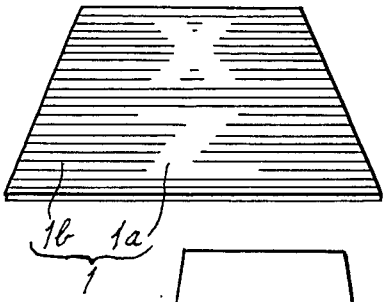
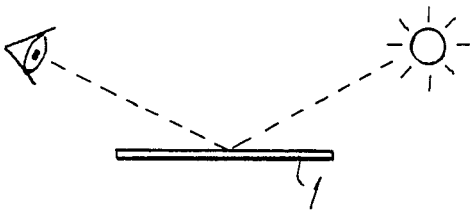
Fig. 5.
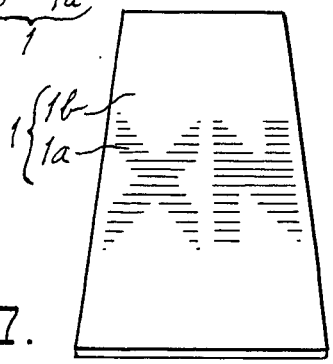
Fig. 7.

Fig. 8.
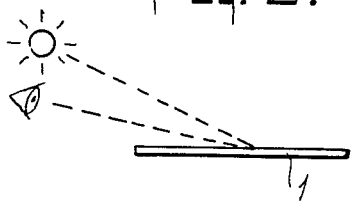
Fig. 9.
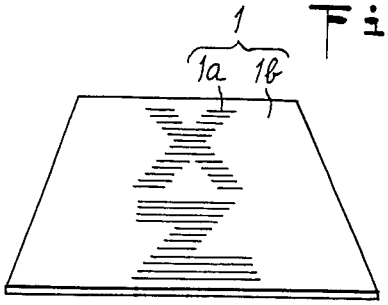
Fig. 10.
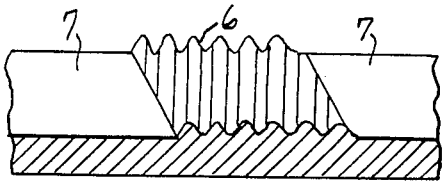
Fig. 11.
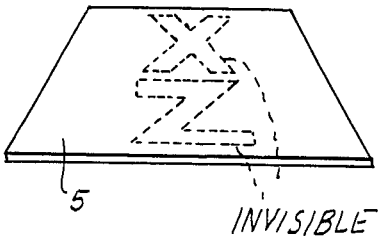
Fig. 12.
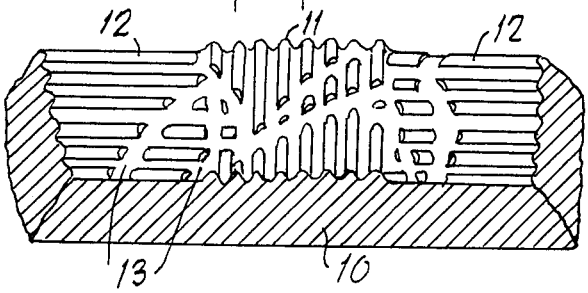
Fig. 13.
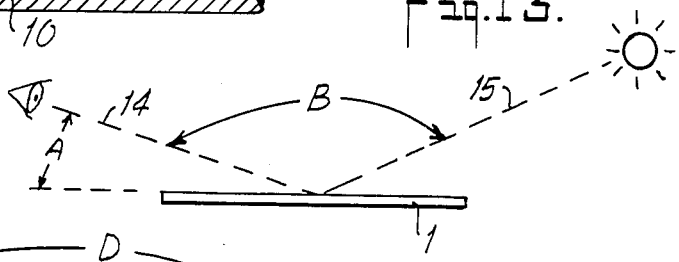
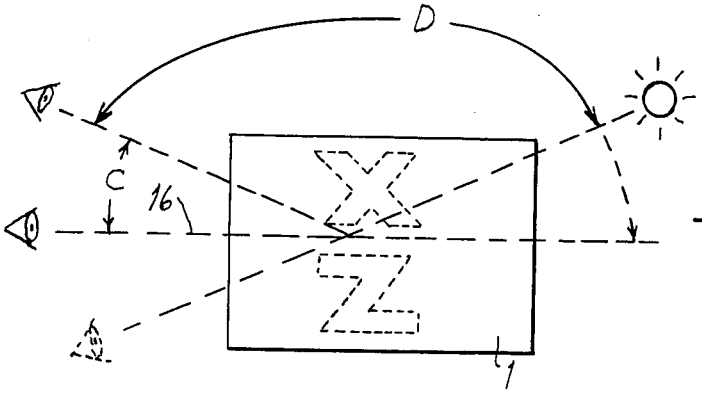
Fig. 14.

Fig. 15.
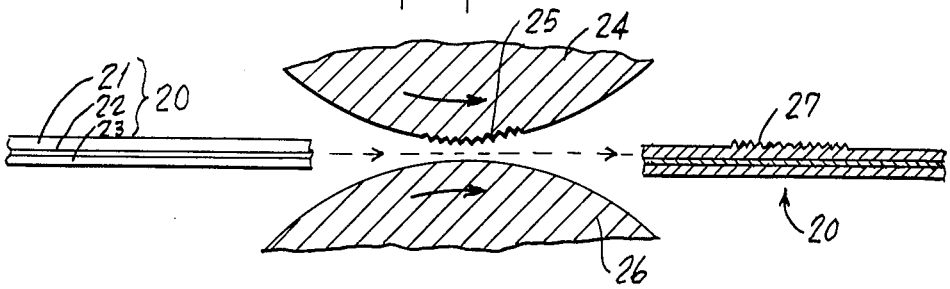
Fig. 16.
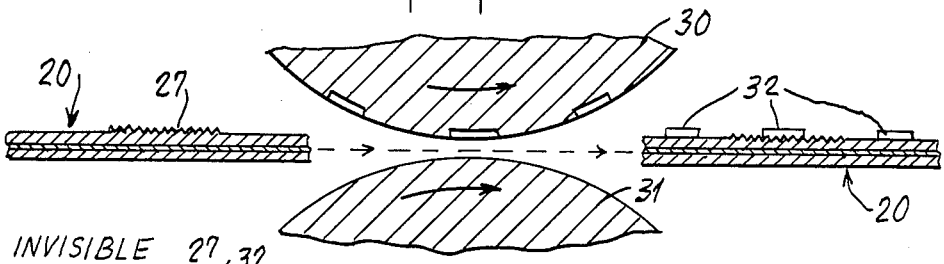
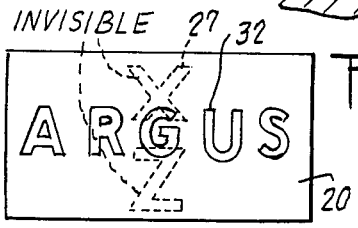
Fig. 17.
Fig. 18.
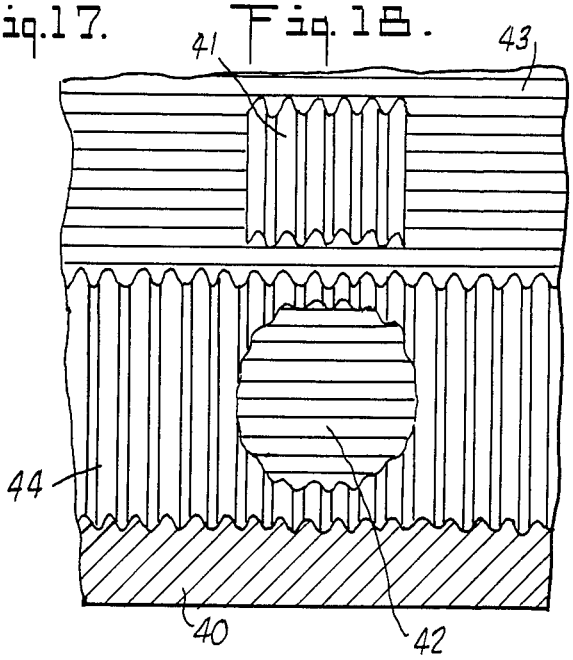
Fig. 19.
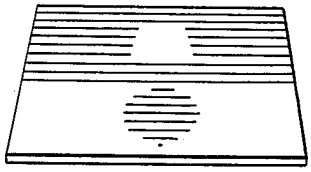
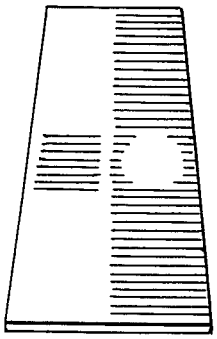
Fig. 20.

DOCUMENTS HAVING A REVEALABLE CONCEALED IDENTIFIER AND THE METHOD OF MAKING SUCH DOCUMENTS

BACKGROUND OF THE INVENTION

Hutton et al., U.S. Pat. No. 4,033,059, shows a method of printing documents including transitory images. The transitory images of that patent are printed in ink lines which contrast in color with the underlying paper or other substrate. The images in certain embodiments of that invention are invisible when viewed perpendicularly to the plane of the paper, but appear when viewed at a small angle to the plane of the paper. Such images are termed "latent images". In other embodiments, the images are visible when viewed along a line of sight perpendicular to the plane of the paper, but disappear when viewed at a small angle. In that case, the images are termed "transient images". The term "transitory image" is defined in the Hutton et al. patent as a generic term inclusive of both latent and transient images.

The U.S. Pat. No. 4,124,947 to Kuhl et al., shows a modification of the documents of Hutton et al., in which the printed intaglio lines have spaced aligned transverse "passageways or streets" having a small width as compared to the spacing between the intaglio lines.

The U.S. Pat. No. 3,471,172, to Bayha, suggests a document in which intaglio lines are printed in ink of a color which has no contrast with respect to the substrate on which the lines are printed. These lines are asserted by Bayha to be invisible and only detectable by an apparatus which detects infrared radiation transmitted through the printed and unprinted areas of the substrate. The documents proposed by Bayha present extreme difficulty in printing, because the press operator cannot tell by inspecting the printed documents when the press is adjusted to supply a proper quantity of ink to the documents. The operator must have an infrared detection apparatus to enable him to adjust the press properly.

BRIEF SUMMARY OF THE INVENTION according to the present invention, a stock material for producing documents of value is produced by impressing an uninked intaglio printing plate against a surface of a printable substrate, thereby producing in that surface an intaglio identifier pattern. That pattern includes foreground areas having a distinctive intaglio pattern of ridges and grooves. The patterns of the foreground areas may differ from each other. Preferably, the ridges and grooves of each foreground area are straight and parallel. Each foreground area is completely surrounded by a background area having an intaglio pattern of ridges and grooves which are distinctively different from and preferably perpendicular to the ridges and grooves in the enclosed foreground area. The concealed identifier pattern may be observed only as a contrast in reflectivity of the foreground and background areas. That contrast may be observed along a line of sight that makes an angle with the plane of the substrate which lies within a first limited range of angles. Furthermore, the orientation of the line of sight with respect to the parallel intaglio lines of the foreground areas must be within a second limited range of angles. Hence, the identifier pattern is readily observable only by an observer who is informed as to the particular pattern he is looking for and as to both of the limited ranges of angle in which the identifier pattern may be recognized.

The identifier pattern may include a masking pattern of curved lines which cross the straight lines of the identifier pattern and which tend to obscure that identifier pattern and make it difficult for an observer to see it.

After the stock material has been prepared by impressing the concealed intaglio pattern on it, a document may be printed thereon with ink which contrasts with the color of the foreground and background areas of the substrate. The printed matter should discontinuously overlap the identifier pattern and be out of register with it. This printed matter makes it additionally difficult to recognize the intaglio identifier pattern. Any method of printing the document may be used, including intaglio, letterpress, offset, silk screen, flexographic, etc.

The degree of concealment of the intaglio pattern in the finished document may be controlled, e.g., by controlling the specularity of the substrate material. It may be made difficult to see without special instruction, but nevertheless observable without optical aid by a trained person. This degree of concealment may be desirable, for example, in the case of labels of relatively expensive goods, where counterfeiting might be expected, and where inspection to detect such counterfeiting may be made carefully. In other cases, such as labels for relatively inexpensive goods, the intaglio pattern may be made readily observable simply for the purpose of providing a distinctive and attractive label.

DRAWINGS

FIG. 1 is a plan view of a sheet of paper on which has been impressed a revealable concealed identifier pattern in accordance with the invention.

FIG. 2 is a cross-sectional view taken on the line 2—2 of FIG. 1, on an enlarged scale.

FIG. 3 is a cross-sectional view taken on the line 3—3 of FIG. 1, also on an enlarged scale.

FIG. 4 is a fragmentary perspective view of a portion of the sheet of FIG. 1, on an even more enlarged scale than FIGS. 2 and 3.

FIG. 5 is a diagrammatic view showing an eye inspecting the sheet of FIG. 1, with the long dimension of the sheet at right angles to the line of sight.

FIG. 6 is a perspective view showing the sheet of FIG. 1 as seen by the eye of FIG. 5, with the concealed identifier pattern revealed.

FIG. 7 is a view similar to FIG. 6, but with the sheet rotated 90°, so that the eye observes it at a different angle of orientation.

FIG. 8 is a view similar to FIG. 5, but with the sheet back-lighted.

FIG. 9 is a view similar to FIG. 6, showing the sheet and the identifier pattern as viewed by the eye of FIG. 8.

FIG. 10 is a view similar to FIG. 4, showing a modification of the invention.

FIG. 11 is a view similar to FIG. 6, showing the modification of FIG. 10 as viewed from a low angle.

FIG. 12 is a view similar to FIG. 4, showing a modified embodiment including a masking pattern.

FIG. 13 is a view as in FIG. 5, but with certain angles identified.

FIG. 14 is a plan view of the sheet of FIG. 13, with certain angles of sheet orientation identified.

FIG. 15 is a diagrammatic view showing apparatus for impressing an intaglio pattern on a laminated sheet.

FIG. 16 is a diagrammatic view showing the printing of an overprint on the laminated sheet which was intaglio printed in FIG. 15.

FIG. 17 shows a plan view of a document which bears an invisible intaglio print and an overprint.

FIG. 18 is a perspective view similar to FIGS. 4 and 9, on a greatly enlarged scale, showing another modification.

FIG. 19 is a view similar to FIG. 6, showing the modification of FIG. 18, as viewed from one angle.

FIG. 20 is a view similar to FIG. 7, showing the modification of FIG. 18, as viewed from another angle.

DETAILED DESCRIPTION

FIGS. 1–4

Figure 21:
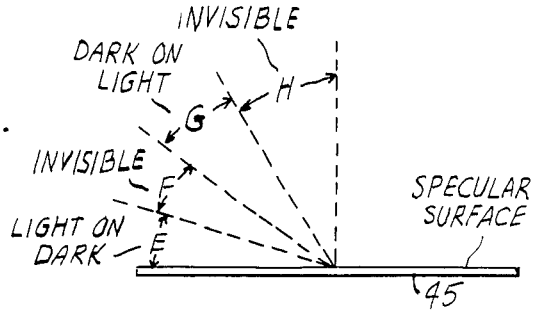
FIG. 21 is a diagrammatic view illustrating another embodiment of the invention.
Figure 22:
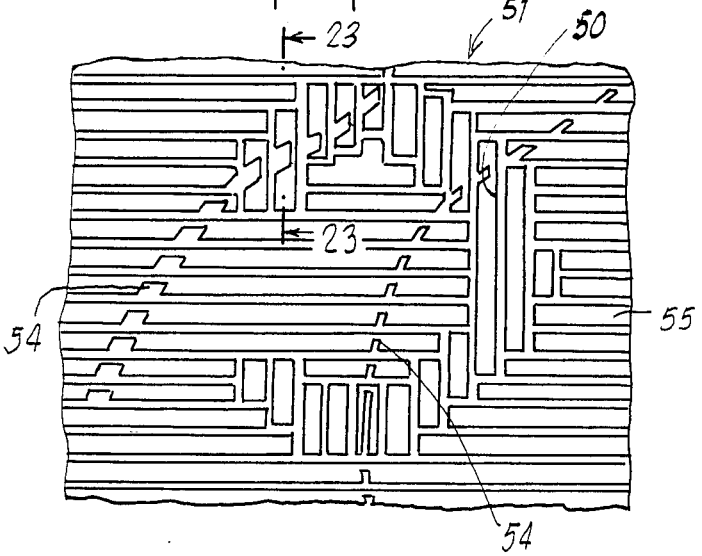
FIG. 22 is a plan view, on an enlarged scale, of an intaglio printing plate intended for the printing of a revealable concealed identifier, employing a masking image according to a modification of the invention.

These figures illustrate one embodiment of the invention, shown in FIG. 1 as a sheet of paper 1 on which the letters X and Z appear in dotted lines 2, marked by the legend "INVISIBLE". FIGS. 2 and 3 are cross-sectional views showing intaglio patterns of ridges and grooves which are impressed upon the sheet 1 without inking. The ridges are raised from the general plane of the paper, the bottom of the grooves are at the same elevation as that general plane, as best seen in FIGS. 2 and 3. The ridges within the outline of the letter X extend vertically of FIG. 1, as may be seen at l*a* in FIGS. 2 to 4. The ridges outside the outline of the letters X and Z extend horizontally of FIG. 1, as shown at l*b* in FIGS. 2 to 4.

While it is presently preferred to make the substrate 1 of paper, other suitable substrates may be employed, as long as they may be deformed by a conventional intaglio process. The material manufactured by DuPont and sold as Tyvek, shown in the U.S. Pat. No. 4,247,318 to Lee et al., may be used. The word "paper" as used in this specification, is intended to be inclusive of such other, paper-like materials, resembling true paper in form and use. As explained below in connection with FIGS. 15 and 16, laminated paper may be used, in which case the intaglio grooves are deeper.

FIGS. 5–6

FIG. 5 illustrates diagrammatically a method of observing the intaglio pattern which is invisible when viewed along a line of sight perpendicular to the plane of the paper as shown in FIG. 1. In FIG. 5, the eye is looking at the sheet from a low angle and the line of sight is directed toward the source of illumination. FIG. 6 shows what the eye in FIG. 5 sees. There is a contrast in reflectivity of the letters X and Z as compared to the reflectivity of the rest of the sheet 1. The letters X and Z appear lighter than the rest of the sheet. The letters X and Z are hereinafter termed the "foreground areas" l*a* of the intaglio pattern and the remainder of the sheet constitutes the "background areas" 1*b* of the pattern.

FIG. 7

If the sheet is now rotated through an angle of 90°, so that the eye looks at the sheet from the narrow side, the contrast in reflectivity is reversed, the letters X and Z appearing darker than the background areas l*b* of the pattern.

FIGS. 8–9

If the sheet 1 is observed when the source of illumination is behind the eye or on the same side of the sheet 1 as the eye, the observed pattern is similar to that of FIG. 7, being the reverse of that of FIG. 6. In other words, the letters X and Z appear darker than the background area 1*b*.

FIGS. 10–11

These figures illustrate a modification of the invention in which a sheet 5 is provided with a foreground intaglio imprint 6 and background areas 7 have no intaglio imprint. FIG. 11 shows how the sheet 5 looks when viewed from the same angle as in FIG. 5. The entire sheet appears light, the letters X and Z not being visible. If the sheet is turned as in FIG. 7, the letters X and Z appear as in that figure, being dark against a light background.

The arrangement shown in FIG. 10, may be reversed, so that the foreground area has no intaglio imprint and the background areas have intaglio imprints. The appearance of the sheet as viewed in FIG. 11 would be the same. If the sheet is turned as in FIG. 7, the letters X and Z would appear light against a dark background. As long as the contrast in reflectivity is maintained, any area may be called a foreground area and any area of contrasting reflectivity may be called a background.

FIG. 12

This figure shows a modification of the invention including a sheet 10 with a foreground area 11 and background areas 12. The contrast between the foreground area 11 and the background area 12 comprise the revealable concealed identifier pattern. Concealment of that pattern is assisted in FIG. 12 by the concurrent use of a masking pattern consisting of curved lines 13, which cross the lines of the foreground area 11 and of the background area 12. Although the lines 13 illustrated in FIG. 12 appear as a random pattern of lines, it assists in the concealment of the foreground area 11 if the lines 13 form a regular pattern, for example, a stylized floral pattern.

FIGS. 13–14

These figures illustrate the angles which must be employed to observe an identifier pattern constructed in accordance with the invention. As shown in FIG. 13, a line of sight 14 makes the angle A with the plane of the sheet 1. For any given pattern, the angle A may be controlled by controlling the depth and width of the lines in the intaglio printing plate. An observer, in order to detect the pattern must know the range of angles A at which the pattern is observable. The range of angles A is not critically limited. There is a best angle, but the pattern is observable from other angles within a certain range extending in each direction from (i.e., larger or smaller than) the angle A. The term "range of angles", as used in this specification, is used broadly and in any particular case may represent two groups of angles having a particular characteristic and which are separated by another group of angles not having that characteristic. For certain patterns and sheet materials, there may be two or more angles A at which the pattern is observable. See FIG. 21 below. The establishment of angle A necessarily determines the angle B between the line of sight 14 and the line 15 between the source of illumination and the sheet 1. This determination arises from the fact that the angle of incidence of the light is equal to the angle of reflection (angle A) by a law of physics, so that angle B is equal to 180° less twice the angle A. FIG. 14 illustrates the angle at which the identifier pattern is observable with respect to the orientation of the sheet 1. The eye should look at the sheet along the line of sight 16, which is within a certain angle C of a line perpendicular to the ridges in the impressed intaglio foreground areas of the letters X and Z. Again the angle C is not critical for any particular pattern but extends over a substantial range. As in the case of the angle A, the angle D between the line of sight and the source of illumination is equal to 180° minus twice the angle C. In order for an observer to detect the concealed intaglio pattern consisting of the letters X and Z, he should know the approximate value of the angles A and C. He should also know the specific pattern he is looking for.

FIGS. 15–17

FIG. 15 shows diagrammatically an apparatus for impressing an intaglio image on a laminated sheet 20 including a cover sheet 21, an adhesive layer 22 and a base sheet 23. The sheet 20 is fed between a pair of printing rollers, including a form roller 24 carrying a plate provided with an intaglio engraving 25 and an impression roller 26 which squeezes the laminated sheet 20 tightly against the form roller 24 so that the sheet 20 emerges with an intaglio impression 27 formed in its upper surface. The grooves of the intaglio engraving may be of any depth and width used in intaglio printing. It is presently preferred to use a depth of 0.0025" and to use 120 lines per inch. In FIG. 16, the sheet 20 with its intaglio impression 27, is subjected to a printing operation in which a printing roller 30 and an impression roller 31 acts on the sheet 20 and adds to its upper surface printed images, as shown at 32. These may be letters, numbers or other patterns. All dimensions of the sheets, the intaglio impression 27 and the printed images 32 are exaggerated in FIGS. 15 and 16. The finished sheet 20 is shown in FIG. 17 and includes the invisible intaglio impression 27 and the printed pattern 32 consisting of the word "ARGUS".

The invention is not limited to the use of laminated sheets. However, if laminated sheets are used, the intaglio ridges formed in the paper will be higher than the ridges formed in a non-laminated sheet. In other words, the grooves between the ridges will be deeper. The laminated sheets may be used in the preparation of labels. In that case, the base sheet 23 is simply a protective sheet to cover the adhesive layer 22 so that after the intaglio impression and the visible printing, the base sheet 23 is stripped away from the adhesive 22. The label is then applied to the container by means of that adhesive.

The intaglio identifier pattern is preferably repeated at frequent intervals or even in abutting arrays of the same pattern over the entire sheet. Such complete repetition of the pattern over the entire sheet avoids any problem of registry between the overprint 32 of FIG. 17 and the identifier pattern.

FIGS. 18–20

FIG. 18 shows in perspective a modification of the invention in which a sheet 40 includes a square foreground area 41 and a circular foreground area 42. The square foreground area 41 is completely within a background area 43. The circular foreground area 42 is entirely within a background area 44. The intaglio ridges in the foreground area 41 are shown vertical as in FIG. 18 and the ridges in the background area 43 are shown horizontal. On the other hand, the foreground area 42 has horizontal ridges and the background area 44 has vertical ridges. By virtue of this arrangement, the sheet 40, when observed from one direction, as in FIG. 19, shows a light square 41 against a darker background 43 and a dark circle 42 against a lighter background 44. When the sheet 40 is rotated through 90° with respect to the observer, as in FIG. 20, the contrast in reflectivity reverses, so that the square 41 appears as a dark area surrounded by a lighter area 43 and the circle 42 appears as a light area surrounded by a darker background area 44.

FIG. 21

In all the embodiments of the invention discussed above, it has been assumed that the sheet on which the intaglio impression was made had a non-specular surface. If the sheet has a specular surface, as for example, if it is provided with a metal coating, then the results are somewhat different. These results are illustrated diagrammatically in FIG. 21. They are believed to be due to the rounded nature of the ridges and grooves formed by the intaglio process in the specular surface. When the line of sight is within a range of small angles E, the contrast in reflectivity of the identifier pattern appears as light foreground areas on dark background areas. When the line of sight is shifted to a range of larger angles F, the pattern becomes invisible. As the line of sight moves into a range G of steeper angles, the same identifier pattern appears as an array of dark foreground areas on light background area. At a range of still steeper angles H of the line of sight, approaching 90°, the pattern again becomes invisible.

The particular ranges of angles shown are not the only possible ranges. The ranges of angles may be varied by changes in specularity, in depth of the grooves, and the width of the grooves in the intaglio plate. As previously mentioned, the angle of incidence is equal to the angle of reflection at any viewing angle.

When a sheet with a specular surface is viewed, parts of the sheet show a visible pattern while other parts do not. The contrasts of reflectivity (light to dark and dark to light) vary in different parts of the sheet because, for any given sheet position, the angle between the line of sight and sheet surface varies over the area of the sheet.

FIGS. 22–23

Figure 23:
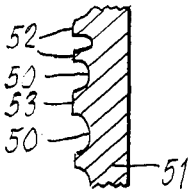
FIG. 23 is a fragmentary cross-section taken on the the line 23—23 of FIG. 22.

These figures illustrate on a greatly enlarged scale, an intaglio printing plate for use in impressing on a sheet of paper or other suitable substrate, a foreground area comprising the letter C, and shown by a series of vertical grooves 50 in the plate 51. The areas between the grooves represent the original surface of the plate, prior to engraving or chemical etching, and now constitute ridges 52, 53 in the surface of the plate, as best seen in FIG. 23. The ridges may be of different widths. See particularly the ridge 53, which is wider than the ridges 52. The horizontal grooves of the background area surrounding the letter C are illustrated at 55. Several different widths of grooves and ridges may be used in the identifier pattern 50 and in the masking pattern shown by the curved lines 54. The use of different widths of lines in the masking pattern makes the identifier pattern less readily observable.

Figure 24:
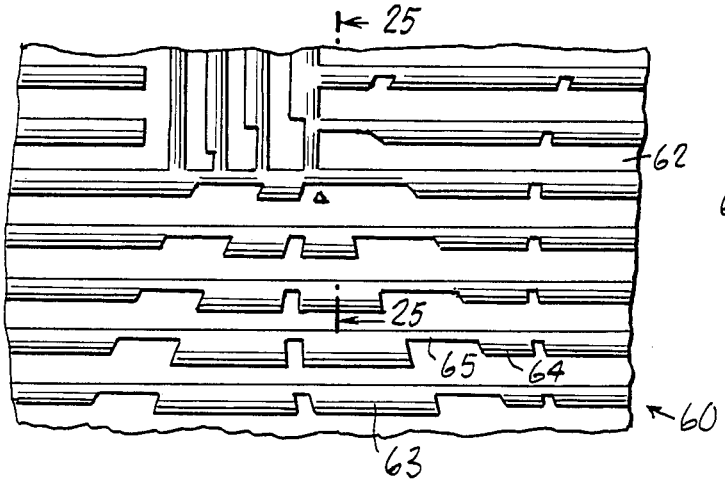
FIG. 24 is a plan view on an enlarged scale showing a portion of a document printed with an intaglio plate. The plate does not conform to the plate of FIGS. 22 and 23.
Figure 25:
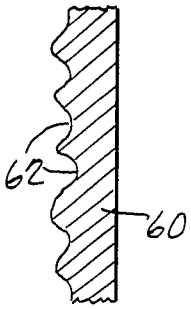
FIG. 25 is a fragmentary cross-section take on the line 25—25 of FIG. 24.

FIGS. 24 and 25

These figures illustrate a sheet 60 on which an intaglio pattern has been impressed. The grooves in an intaglio plate produce ridges when a sheet 60 is forced against the plate. The raised ridges in the intaglio plate produce grooves 62 in the sheet 60. The paper or other material of the sheet 60 does not conform exactly to the intaglio plate, so that the ridges and grooves formed in the sheet 60 have rounded contours, whereas the ridges in the intaglio plate generally have sharp edges although the grooves themselves commonly have rounded contours. As is typical in intaglio work, the contours involved are so small that minor variations in dimensions from one ridge to the next are not observed in the final product.

As seen in FIG. 24, there are three different widths of ridges appearing in the final product, shown respectively at 63, 64, 65. These three different widths of ridges are employed to define the masking pattern which obscures the identifier pattern and makes it harder to observe.

While the identifier patterns illustrated have been known as comprising ridges and grooves which are distinguished from the surrounding background areas by a perpendicular relationship, that relationship is not absolutely necessary. Distinctive differences between the foreground and background patterns may be secured with lines which vary considerably from the perpendicular relationship. However, the perpendicular relationship does provide a maximum distinction between the foreground and background areas and makes them more readily observable.

We claim:

1. Stock material for printing documents, said material having a revealable, at times concealed identifier, comprising:

a. a paper substrate having a nonspecular printable surface;

b. an intaglio idenitifier pattern impressed in said substrate surface without ink and defined by foreground areas surrounded by background areas having no color contrast with the foreground areas, said foreground areas having distinctive intaglio forms of ridges and grooves, said background areas having intaglio forms of ridges and grooves distinctively different from those of the adjacent foreground areas, said intaglio identifier pattern being visible only as a contrast in reflectivity of the foreground and background areas and only when observed along a line of sight that: (1) has an angle with the substrate surface which lies within a first limited range of angles; and (2) has an angle of orientation with respect to the ridges of the foreground areas which lies within a second limited range of angles.

2. Stock material as in claim 1, including a first foreground area having parallel ridges and a second foreground area having parallel ridges perpendicular to the ridges in said first foreground area; and a first background area surrounding said first foreground area and having ridges perpendicular to the ridges in said first foreground area and a second background area surrounding said second foreground area and having ridges perpendicular to the ridges of said second foreground area.

3. A document having a revealable, at times concealed identifier, comprising:

a. a paper substrate having a nonspecular printable surface;

b. an intaglio identifier pattern impressed in said nonspecular substrate surface without ink and defined by foreground areas surrounded by background areas having no color contrast with the foreground areas, said foreground areas having distinctive intaglio forms of ridges and grooves, said background areas having intaglio forms of ridges and grooves distinctively different from those of the foreground areas, said intaglio identifier pattern being visible only as a contrast in reflectivity of the foreground and background areas and only when observed along a line of sight that: (1) has an angle with the substrate surface which lies within a first limited range of angles; and (2) has an angle of orientation with respect to the ridges of the foreground areas which lies within a second limited range of angles; and c. matter printed on said substrate in a color contrasting with the color of said foreground and background areas, said printed matter being out of register with said identifier pattern so that at least a portion of the identifier pattern is observable apart from the printed matter.

4. The method of producing a revealable, at times concealed identifier pattern of variable appearance in a printable substrate, comprising the step of impressing an uninked intaglio plate against a nonspecular surface of the substrate, said plate carrying an intaglio identifier pattern including foreground areas surrounded by background areas, said foreground areas having distinctive intaglio forms of grooves in the surface of the plate, said background areas having intaglio forms of grooves distinctively different from those of the foreground areas, thereby producing in said substrate an identifier pattern of ridges and grooves, said pattern being invisible when observed along a line of sight normal to the substrate surface, but visible only as a contrast in reflectivity when observed along a different line of sight making a small acute angle with the substrate surface.

5. The method of claim 4, in which said identifier pattern is repeated at intervals over the entire surface of the substrate.

6. The method of printing a document having a revealable, at times concealed identifier pattern, comprising the steps of:

a. impressing an uninked intaglio plate against a nonspecular surface of a printable substrate, said plate carrying an intaglio identifier pattern including foreground areas surrounded by background areas, said foreground areas having distinctive intaglio forms of grooves in the plate surface, said background areas having intaglio forms of grooves distinctively different from those of the foreground areas, thereby producing in said substrate surface a pattern visible only as a contrast in reflectivity of the foreground and background areas; and b. printing matter on said substrate in a color contrasting with the color of said foreground and background areas, said printed matter being out of register with said identifier pattern.

7. Stock material for printing documents, said material carrying a revealable, at times concealed identifier pattern, comprising:

a. a paper substrate having a nonspecular printable surface;

b. an intaglio identifier pattern impressed in said nonspecular substrate surface without ink and defined by foreground areas surrounded by background areas having no color contrast with the foreground areas, said foreground having distinctive intaglio forms of ridges and grooves, said background areas having intaglio forms of ridges and grooves distinctively different from those of the adjacent foreground areas, said pattern being visible only as a contrast in reflectivity of the foreground and background areas.

8. A document carrying a revealable, at times concealed identifier pattern, comprising:

a. a paper substrate having a nonspecular printable surface;

b. an intaglio identifier pattern formed in said nonspecular substrate surface without ink and defined by foreground areas separated by background areas having no color contrast with the foreground areas, said foreground areas having distinctive intaglio forms of ridges and grooves, said background areas having intaglio forms of ridges and grooves distinctively different from those of the foreground areas, said pattern being visible only as a contrast in reflectivity of the foreground and background areas; and c. matter printed on said substrate in a color contrasting with the color of said foreground and background areas, said printed matter being out of register with said identifier pattern so that at least a portion of the identifier pattern is observable apart from the printed matter.

* * * * *